United States Patent [19]

Lai

[11] Patent Number: 5,006,969

[45] **Date of Patent: * Apr. 9, 1991**

[54] FLASHLIGHT WITH END CAP SWITCH

[75] Inventor: Larry Lai, Chia-Yi Hsien, Taiwan

[73] Assignee: Plum Industrial Co., Ltd., Chiayi Hsien, Taiwan

[ * ] Notice: The portion of the term of this patent subsequent to Jan. 8, 2008 has been disclaimed.

[21] Appl. No.: 430,619

[22] Filed: Oct. 31, 1989

[51] Int. Cl.[5] ..... F21L 7/00

[52] U.S. Cl. ..... 362/206; 362/207

[58] Field of Search ..... 362/202, 203, 206, 207

[56] References Cited

U.S. PATENT DOCUMENTS 3,201,542 8/1965 Hutchison ..... 362/202 X 4,819,141 4/1989 Maglica et al. ..... 362/207

*Primary Examiner*—Allen M. Ostrager

*Attorney, Agent, or Firm*—Fleit, Jacobson, Cohn, Price, Holman & Stern

[57] ABSTRACT

A flash-light has a light-shell, a cylinder, a bottom cover which can be screwed to touch the bottom side of the cylinder, thus, the circuit of the bulb can be easily controlled.

3 Claims, 5 Drawing Sheets

FLASHLIGHT WITH END CAP SWITCH

BACKGROUND OF THE INVENTION

The conventional flashlights are installed with dry cells in the cylinder, and using their rotative bottom cap to link both the positive pole and negative pole of the cell to the bulb. Thus, with a switch in one of the poles, the on-and-off function can be controlled. Besides, while the cylinder diameter is fixed, it can only use the proper dry cells, otherwise it does not work.

SUMMARY OF THE INVENTION

The object of this invention is to provide a new structure and to use the rotative bottom cap to control the cell current.

The other object of this invention is to provide a flashlight which can suit more than two kinds of dry cells.

Another object of this invention is to provide a flashlight, which has a spare bulb that can be replaced when the original one fails.

The structure includes a cylinder, a light-shell, and a bottom cover. The light-shell links with the front end of the cylinder, the rear end meets the rotative bottom cap. By rotating the bottom cap, the cell current can be controlled.

BRIEF DESCRIPTION OF THE DRAWINGS

This invention will now be described in detail with reference to accompanying drawings wherein.

DETAILED DESCRIPTION OF THE INVENTION

Figure 1:
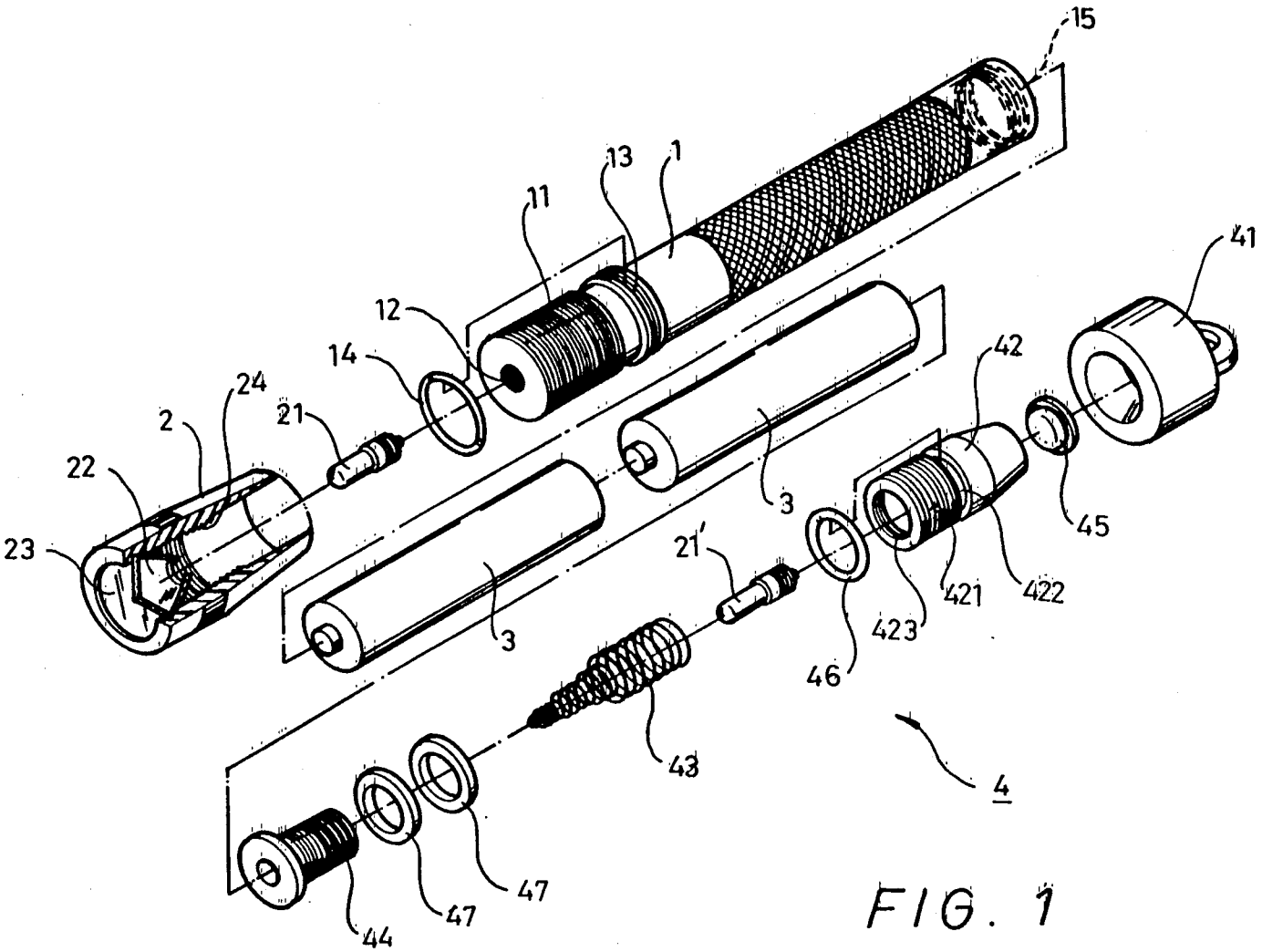
FIG. 1 is an exploded perspective view of the flashlight of the present invention.

Referring to FIG. 1, the flashlight in accordance with the present invention includes a cylinder 1. It has outer threads 11 on the top for the light-shell. It also has inner threads 12 for the bulb 21. When the bulb 21 screws in, it makes contact with one end of the cell 3. For proof against water, after bulb 21 screw-in, a concave groove 13 with a leakage-proof rubber ring 14 tightly engages the light-shell. Thus, no water can infiltrate.

Cylinder 1 is for the dry cells 3. The inner thread 15 in its rear end matches the thread 42 of the bottom cover 4.

Light-shell 2 engages the outer thread 11 on cylinder 1 with its inner threads 24. The light-shell 2 has a light condenser 22, which can properly reflect all the light from the bulb and concentrate same. The limpid glass 23 can resist any infiltration.

The rear cover 4 consists of the cap 41, whorl ring 42, spring 43 and inner plug 44. The cap 41 is made of conductive material, with a whorl 42 stuck inside. The circular whorl 42 is made of non-conductive material, such as plastic, with a metal padding ring 45 in its end. The outer thread 421 on whorl 42 is for threading in the inner thread 15. The whorl 42 itself has a concave groove 422, for the leakage-proof rubber ring 46. It has also inner thread 423 to match the inner plug 44, and a spring 43. The spring 43 is made of conductive material, while the non-conductive inner plug 44 has a hole for the spare bulb 21, and its outer part matches padding ring 47. The outer diameter of the non-conductive padding ring 47 is the same as the inner diameter of cylinder 1.

Figure 2:
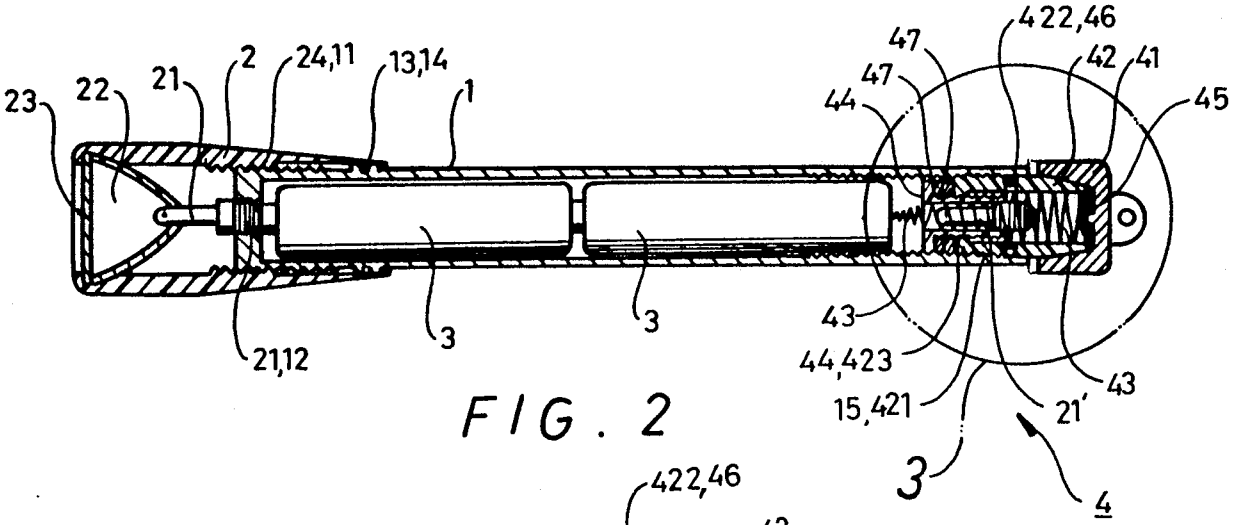
FIG. 2 is a cross-sectional view of taken along line 2—2 of FIG. 4.
Figure 3:
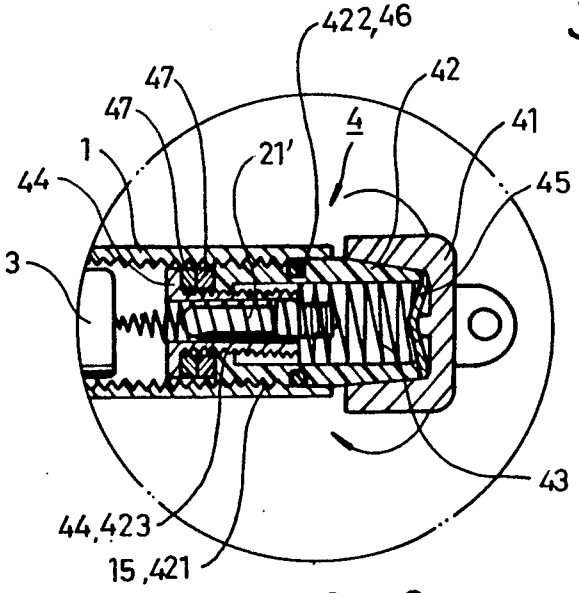
FIG. 3 is an enlarged view of the portion 2 in FIG. 2.
Figure 4:
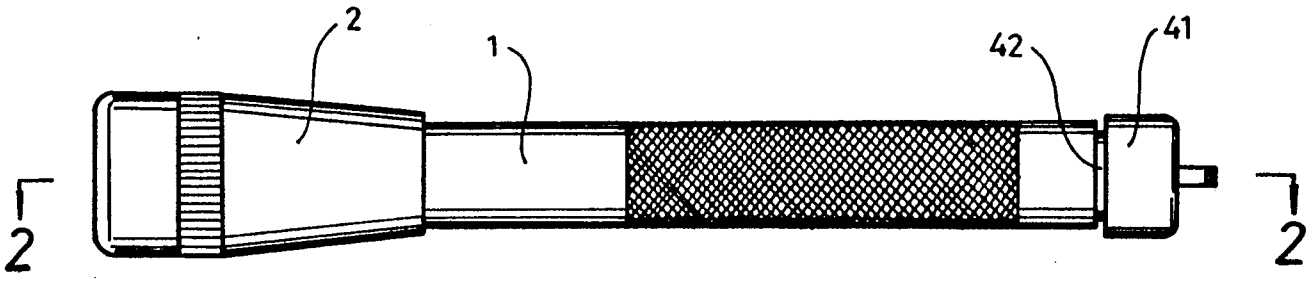
FIG. 4 is an outer view of the present invention.

Referring to FIGS. 2 and 3, the inner thread 12 in the top of cylinder 1 is for bulb 21. The outer thread 11 is for light-shell 2 and the dry cells 3 are placed in cylinder 1. Cap 41 and whorl 42 are stuck together, while the whorl 42 has a spring 43 and a spare bulb 21, screwed together by inner plug 44. The spring 43 is pyramidic in shape. One of its end touches the metal padding ring 45, while the other end touches the dry cell through the hole of inner plug 44. Therefore, one pole of the cell 3 links to the cover 41, as shown in FIGS. 2, 3 and 4. While the cap 41 is apart from cylinder 1, no current can reach bulb 21. If the cap 41 is tightly screwed, forming a circuit, the bulb 21 lights.

Figure 5:
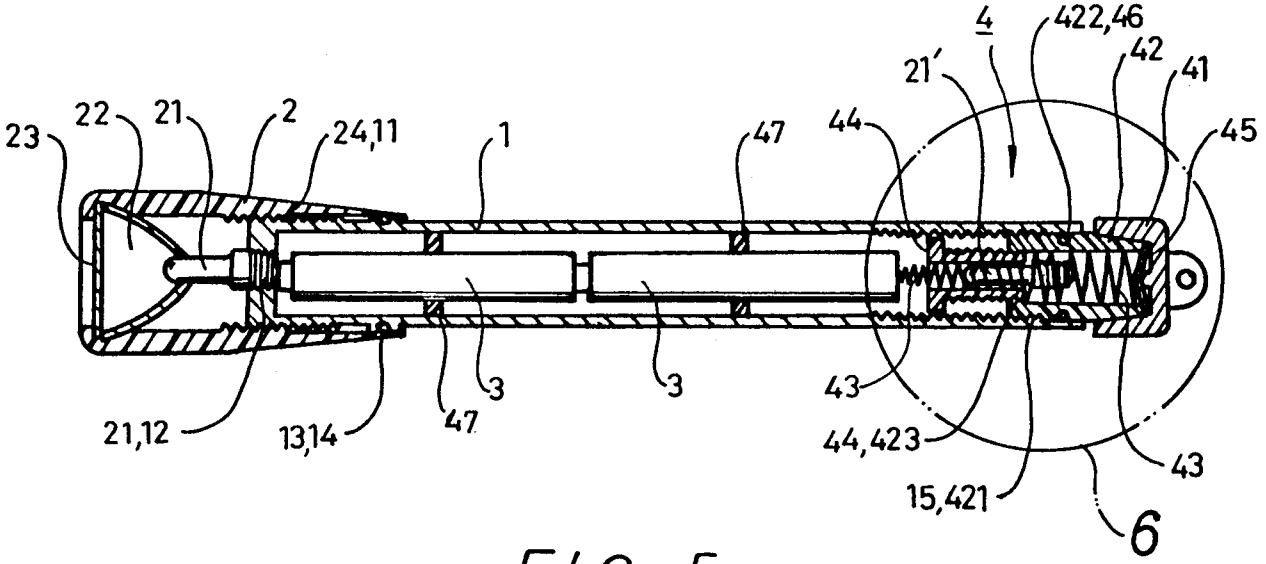
FIG. 5 and FIG. 5A are views similar to FIG. 2 showing smaller cells which replace the original cells in FIG. 2.
Figure 5A:
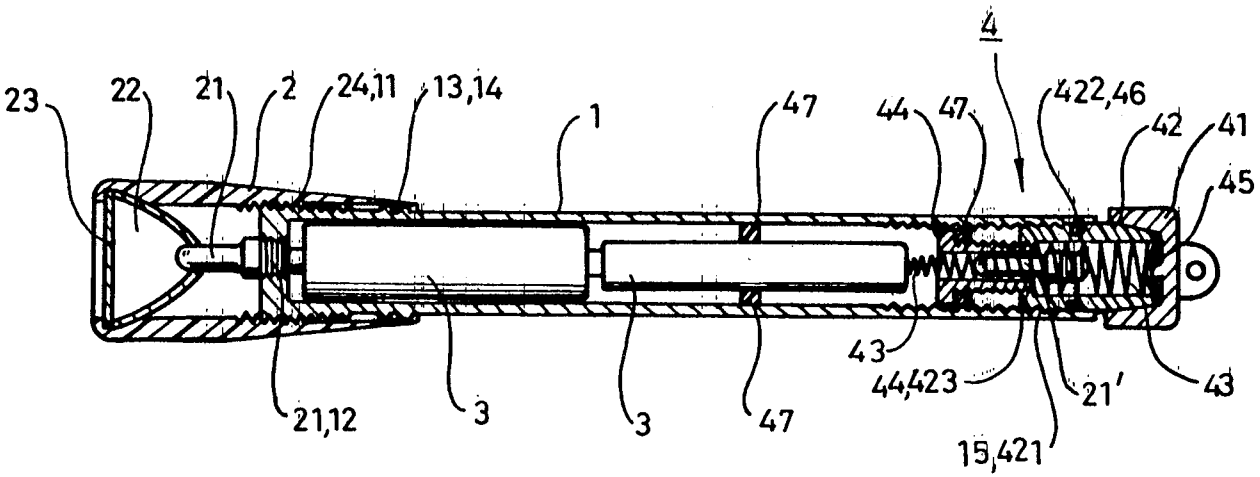
Figure 6:
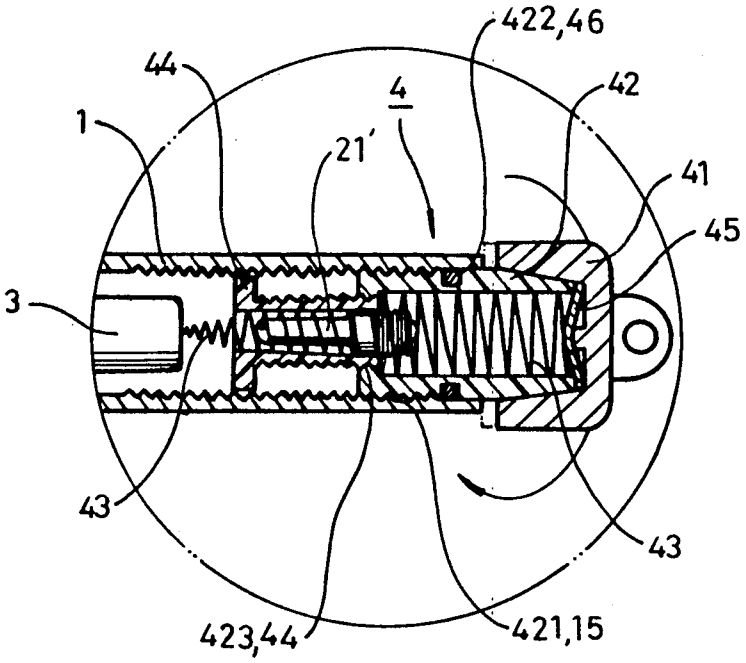
FIG. 6 is an enlarged view of the portion 6 in FIG. 5.

Referring to FIGS. 5, 6 and 7, when dry cells differ in their diameter and length, pug the padding ring 47 on the cell 3, screw in the inner plug 44, the spring 43 can extend, and touch the bottom of the cell, the circuit is completed. Therefore, using the screw of the cap 41, the circuit is freely controlled.

What is claimed is:

1. A flashlight comprising a conductive cylinder for receiving at least one dry cell, a mount at one end of the cylinder for a light bulb, said one end of the cylinder having an external thread, an internally threaded light-bulb shell for threading on said external thread, said cylinder having an opposite end with an internal thread, a non-conductive whorl ring with an outer thread to fit said internal thread, the whorl ring carrying an axially extending spiral spring for electrically contacting a dry cell in the casing, and a conducting cover on a rearward end of the whorl ring for selectively engaging and disengaging the casing by inwardly and outwardly threading the whorl ring on said internal thread thereby selectively completing and breaking a circuit containing the light bulb and dry cell so as to activate and deactivate the light bulb.

2. The invention defined in claim 1, wherein the whorl ring has a forward end with a screw-in plug, said spring extending through a bore in the plug, and wherein a padding ring having an external diameter corresponding substantially to an internal diameter of the casing is carried on the plug for use on an undersized cry cell to snugly accommodate same in the casing.

3. The invention defined in claim 2 which includes a replacement light bulb contained in said bore, said spring surrounding the replacement light bulb.

* * * * *